United States Patent [19]

Pruneda-Caridad

[11] Patent Number: 4,818,501

[45] Date of Patent: Apr. 4, 1989

[54] MACHINE FOR STERILIZING LIPSTICKS

[76] Inventor: Jacinto Pruneda-Caridad, Pza Nicaragua, 11-7o B Mostoles, Madrid, Spain

[21] Appl. No.: 66,830

[22] Filed: Jun. 25, 1987

[30] Foreign Application Priority Data

Jul. 24, 1986 [ES] Spain ..... 8600532

[51] Int. Cl.[4] ..... A61L 2/00

[52] U.S. Cl. ..... 422/300; 422/38

[58] Field of Search ..... 422/292–299, 422/300, 38; 110/349; 53/425, 426; 126/401, 406, 407; 424/64

[56] References Cited

U.S. PATENT DOCUMENTS

| | | | |
|---|---|---|---|
| 1,348,837 | 8/1920 | Allen | 422/299 |
| 2,214,946 | 9/1940 | Werner | 422/293 |
| 4,338,282 | 7/1982 | Motooka et al. | 422/299 |

*Primary Examiner*—Barry S. Richman
*Assistant Examiner*—T. J. Wallen
*Attorney, Agent, or Firm*—Lucas & Just

[57] ABSTRACT

A machine for sterilizing lipstick has a carriage which moves on a bench and holds and rotates the lipstick bar in front of a bank of Bunsen burners. The carriage rotates the lipstick in front of the Bunsen burners to sterilize and smooth the exterior of the lipstick bar. The carriage prevents the lipstick from rotating when the lipstick bar is not in front of the Bunsen burners.

11 Claims, 5 Drawing Sheets

MACHINE FOR STERILIZING LIPSTICKS

This invention relates to a machine for sterilizing and finishing lipstick in the cosmetics industry.

Lipstick bars are made by molding a liquid cream which, on cooling, solidifies. The bars then undergoing a surface finishing phase, to provide the bar with a pleasant appearance and eliminating every trace of previous handlings.

The finishing phase is at present carried out manually by operators skilled in this work, passing the bar through a flame produced by a suitable device, such as a Bunsen burner.

This operation is complicated, expensive, and offers no guarantees of a proper result. The machine of the present invention is intended to automate this process, thereby simplifying its performance, obtaining a more economical result and affording greater guarantees of efficiency.

For that purpose, the machine of the present invention is made with a mobile carrying bench, equipped with casters for its movement, and with means of leveling and stationary anchoring of the machine. The bench defines a projecting table top, on which it incorporates a set of mechanisms that includes a carriage movable in front of a sterilizing installation. The sterilization installation is formed by a block of burners. A set of position detectors are positioned on the table. The carriage being driven by double-acting pneumatic cylinders that can be controlled from either one of both ends by means of respective push buttons.

The carriage integrates in a bearing unit a rotary support of the cartridge containing the bar to be sterilized. The support possessing a pinion that engages in a longitudinal stationary rack parallel to the movement of the carriage. While on the carriage jaws capable of blocking the collar of the cartridge are incorporated. These jaws being operated by a pneumatic cylinder, which is controlled by the position detectors as a function of the location of the carriage during tavel. The jaws in a first phase of advance are closed. The jaws are then opened in an intermediate phase and closed again in the final phase.

In this way, on advancing the carriage, the bar to be sterilized is passed through the flame of the burners and turns due to the rotation imparted by the advance to the cartridge support, the same movement and the rotary action producing the automatic outlet of the bar from the cartridge in the first phase of advance and the subsequent introduction of same in the final phase.

The machine of the present invention offers substantial advantages over the manual processes in the quality aspect. The present invention makes it possible to obtain a spectacular luster in the bars, uniformly distributed on the entire surface, the complete disappearance of marks and the absence of deformations of the original outlines. This is done by melting the mass of the bar very superficially, while the qualities fundamental to the appearance of the bar are maintained.

Important productivity advantages are likewise obtained. One operator can carry out, with minimum effort and attention, all the operations of taking out the bar, sterilizing, reintroducing the bar and putting the cap on the cartridge.

These advantages are enhanced by the possibility of selecting the double-acting sterilizing cycle, one cycle being completed on advance of the carriage and another on the backward motion, working with two persons, one at each end, so that a very high production rate can be obtained.

It is to be added that when the machine is not in use, it can be removed to a portable machine parking zone, so that a permanent space is not required in its work area; and, furthermore, because of its structural design, with a projecting table, the machine can be coupled at any point and position, when the process uses belt conveyors for the movement of parts. The basic problems of automation for which it is intended having been solved, it makes it possible to tackle the automation of other operations of the bar finishing phase.

To understand the nature of the invention better, we represent, by way of merely illustrative and nonlimitative example, one preferred industrial embodiment, to which we refer in our specification, to the drawings wherein.

Figure 12:
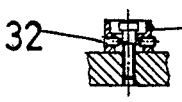
Figure 13:
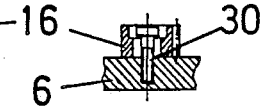

FIGS. 12 and 13 correspond to respective cross sections in elevation for each of the fastening points of the rack with and without stop rods.

Figure 14:
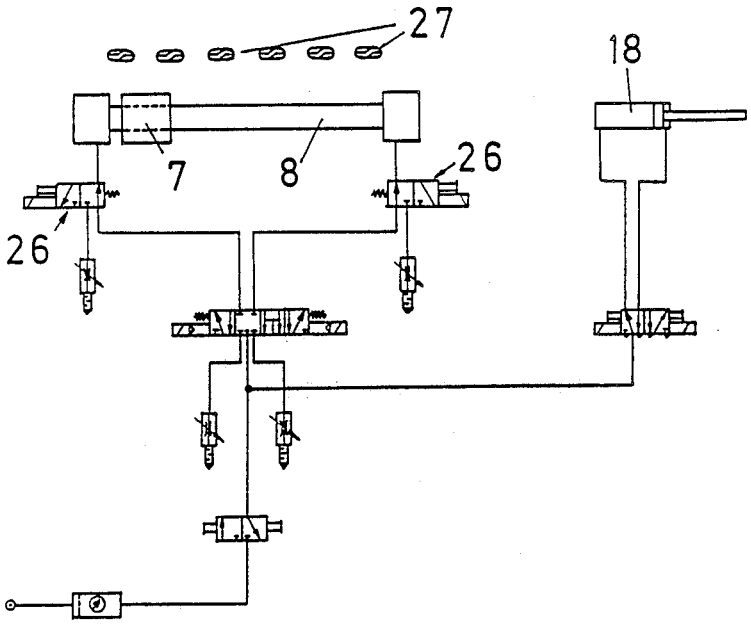

FIG. 14 is a representation of the pneumatic drive system of the machine.

Figure 15:
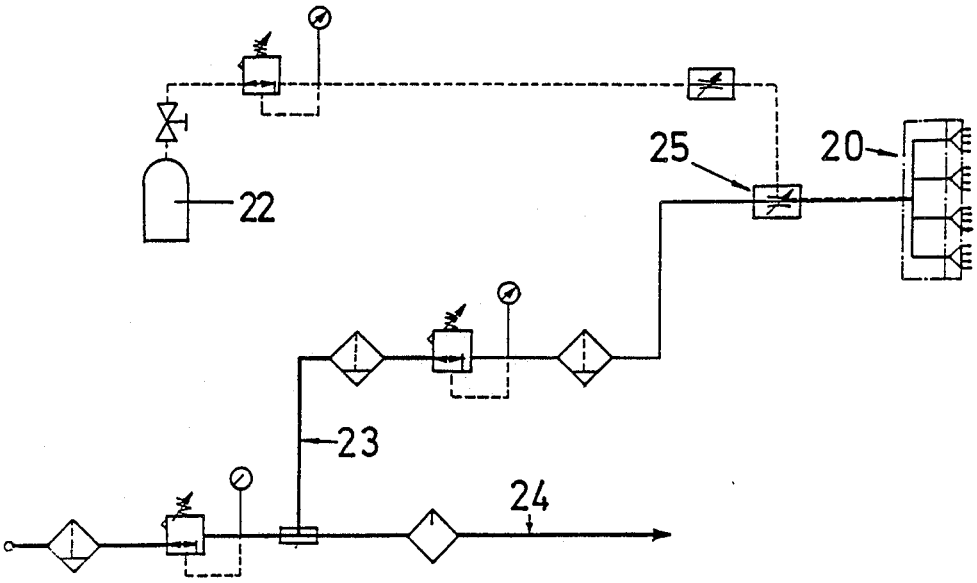

FIG. 15 is a representation of the system of gas-air supply to the sterilizing installation.

In accordance with the present invention, the sterilizing machine has carrying bench (1), which is equipped with casters (2) for movement and leveling units (3) for leveling and stationary seating in the machine. The top of bench (1) has projecting table (4). In the vertical part of the machine there is cabinet (5) that makes it possible to store and protect all of the appropriate units of the machine.

Figure 1:
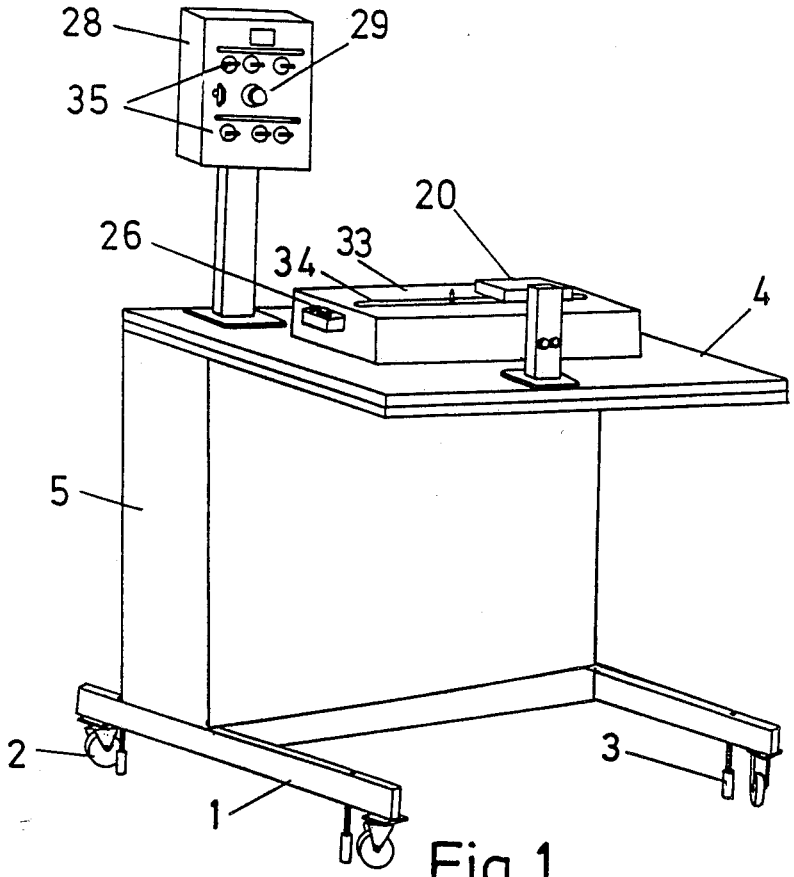
FIG. 1 shows a general perspective of the machine of the present invention.
Figure 2:
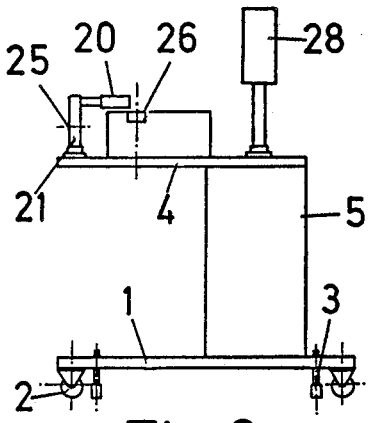
FIGS. 2 and 3 are each sectional and front elevation views of the machine.
Figure 3:
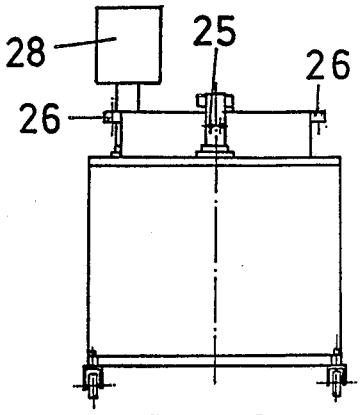
Figure 4:
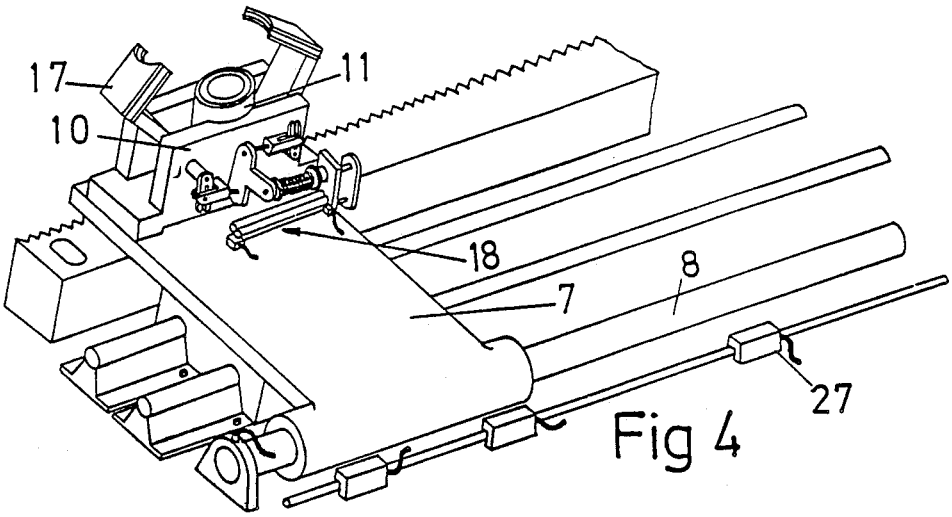
FIG. 4 represents a perspective of the functional assembly of mechanisms, with the carriage at each end and the jaws blocking the collar of the cartridge in open position.
Figure 5:
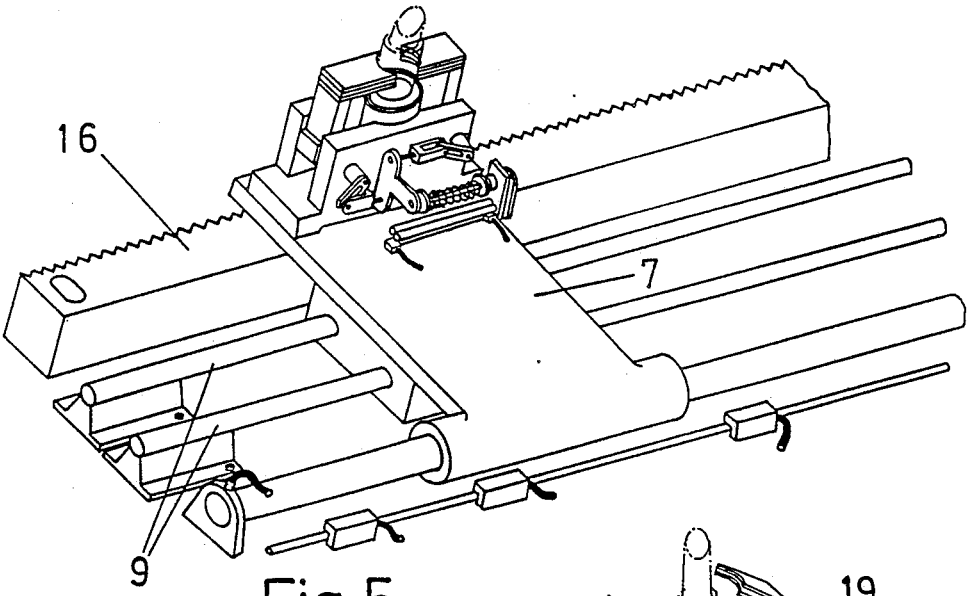
FIG. 5 is a similar perspective of the assembly of mechanisms, with the carriage in an intermediate position and the jaws closed, with the bar to be sterilized coming out of the cartridge and represented in dots and dashes.
Figure 6:
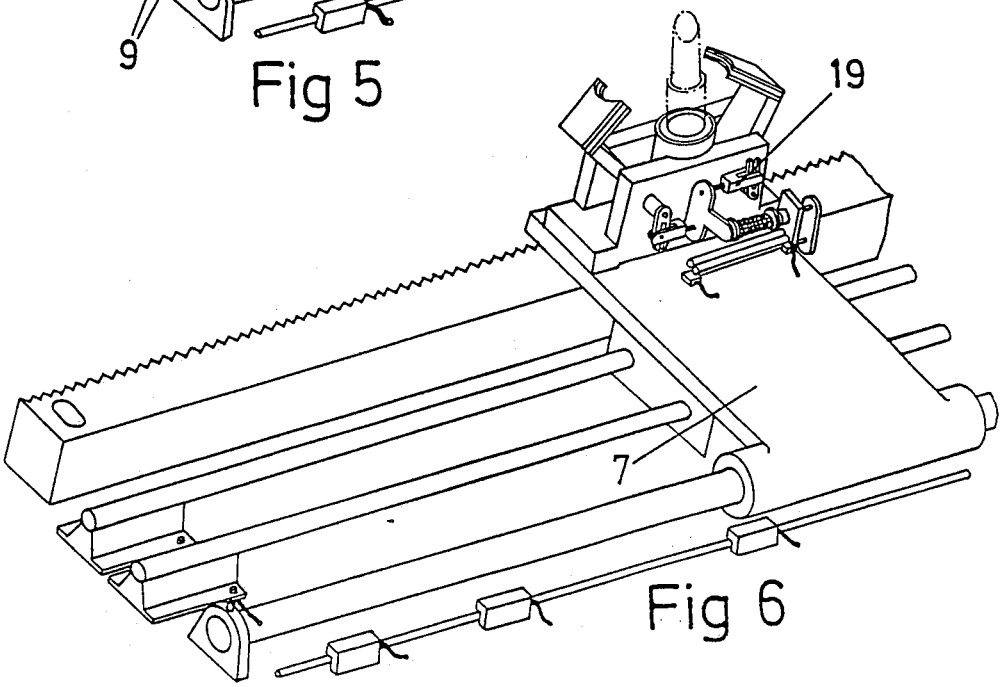
FIG. 6 is another similar perspective of the assembly of mechanisms, with the carriage in a more advanced position and the jaws reopened.
Figure 7:
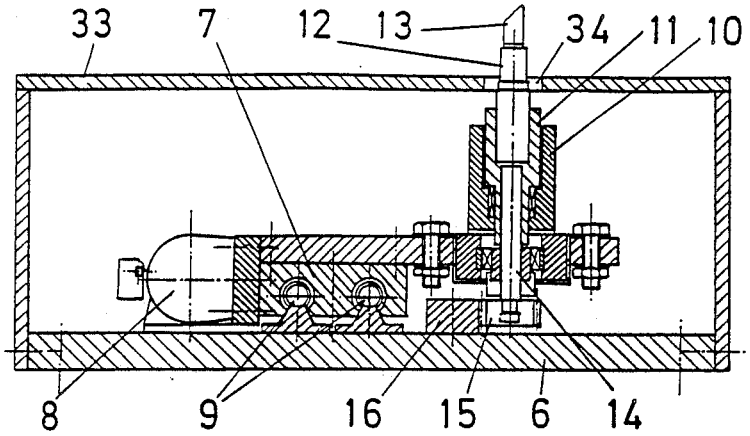
FIG. 7 is a cross section of the assembly of mechanisms.
Figure 8:
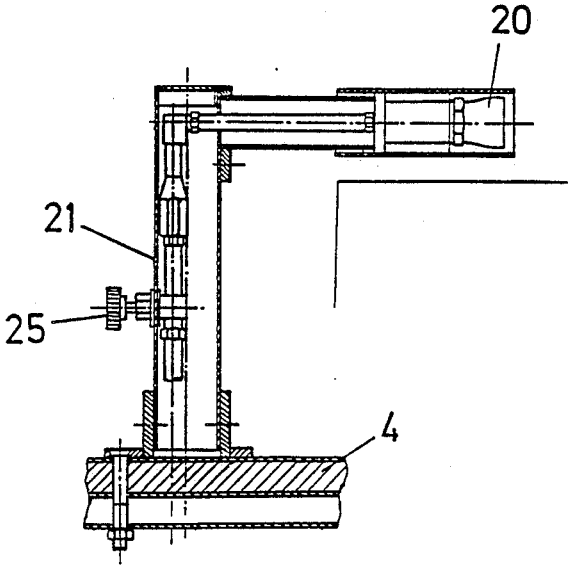
FIG. 8 is a section of the block of burners and of the unit carrying same.
Figure 9:
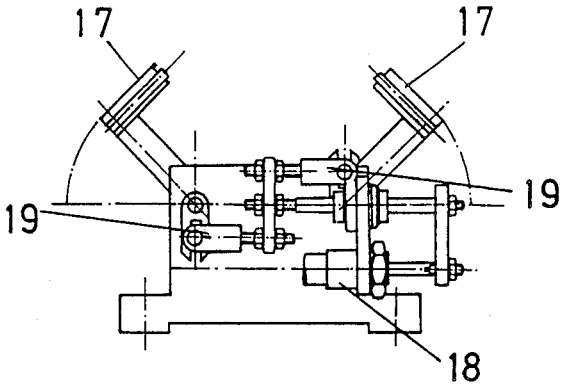
FIG. 9 is a front elevation view of the cartridge blocking mechanism.
Figure 10:
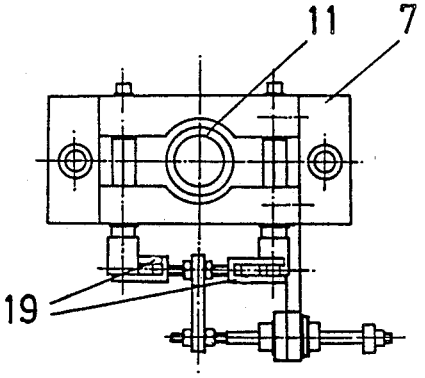
FIG. 10 is a corresponding plan view of said cartridge blocking mechanism, neither the drive cylinder nor the jaws having been represented, in order to simplify the drawing.
Figure 11:
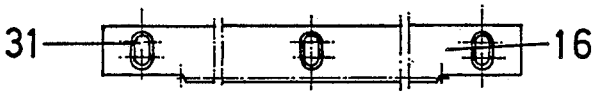
FIG. 11 is a plan view of the rack defining the rotation of the cartridge support.

On table (4) an assembly of mechanisms is mounted, see FIG. 7. These mechanisms are arranged on base plate (6) fastened to table (4). The assembly including moving carriage (7) that is connected to pneumatic drive cylinder (8). Carriage (7) is mounted on longitudinal skids (9).

Integrated with cariage (7) is block (10), which includes tool (11). Tool (11) is provided to incorporate cartridge collar (12) which has lipstick bar (13) to be sterilized. Tool (11) is integral with shaft (14) mounted in free rotation. Shaft (14) possessing pinion (15) that engages rack (16) fastened on base plate (6) in a longitudinal arrangement parallel to the travel of carriage (7).

Also mounted on carriage (7) is a mechanism formed by jaws (17) which is driven by a pneumatic cylinder (18), through forks (19), making possible the blocking of cartridge collar (12), which is located on support tool (11).

In front of the assembly of mechanisms and centered in relation to the travel of carriage (7) is a sterilizing installation. The sterilizing installation is formed by a block of burners (20) which are fastened to bearing column (21) connected to table (4).

Block of burners (20) is fed with a mixture of gas and air supplied from respective pipes according to the diagram of FIG. 15. The gas emanates from corresponding tank (22), which can be a commercial butane gas bottle. The air is taken through by-pass (23) from the same source with which it is supplied to pipe (24) of the pneumatic circuit of cylinders (8) and (18) driving the carriage (7) and the jaws (17) respectively, see FIG. 14.

Different pressure adjustments in corresponding pipes make possible the supply under suitable conditions of the gas and air for feeding the burners, while on column (21) control (25) is incorporated that makes regulation of the flame possible by means of variation of the mixture of gas and air.

With all that, by starting the movement of carriage (7), the latter advances, carrying with it support (11) on which are placed cartridges (12) of the lipstick bars to be sterilized. Support (11) is driven in rotated during movement due to the relationship between pinion (15) and rack (16).

In the course of the movement, bar (13) is sterilized by the flame of burners (20). The sterilization is achieved in an efficient and totally uniform manner by providing for one or more three hundred degree rotations of the lipstick bar in the flame zone.

This operation can be duplicated, that is, the sterilizing action on bar (13) repeated twice in the cycle of travel of carriage (7), if a round trip of the carriage is provided for in the cycle.

Now, by means of programming of the machine, the complete travel of the carriage can be provided for in the same way for two sterilizing cycles, one in the advance and the other in the backward motion. Drive cylinder (8) of carriage (7) has two push buttons (26) available, one placed at each end, so that, according to the programming, the machine can be operated by a single person from one end in cycle programming with complete travel of the carriage, or else by two persons, one at each end, in double-cycle programming, which makes it possible to increase productivity considerably.

During the advance of carriage (7), the automatic outlet of bar (13) from its cartridge collar (12) takes place automatically. This is due to the rotation produced on advance where jaws (17) in the first phase of the travel cause the blocking of cartridge collar (12). Bar (13) being made to come out on rotation of the latter, the former being blocked, said blocking being released in the phase of travel corresponding to the flame zone, so that in the flame zone bar (13) turns together with support (11), sterilizing occurring under the conditions indicated, and once the flame zone is passed, in the last phase of travel, jaws (17) again block the collar of cartridge (12), so that bar (13) stops rotation and is reintroduced in the collar cartridge.

Along the travel of carriage (7) a series of position detectors (27) are arranged, which control operation of drive cylinder (18) of jaws (17), in order to activate closing of the latter in the first and last phase of travel, causing their opening in the intermediate phase corresponding to sterilizing.

According to the programming selected, for one or two sterilizing cycles, jaws (17) will be closed in the first phase of advance of carriage (7) and in the last phase of the backward motion of same, or else in the first and last phases of advance, as well as of the backward motion. Jaws (17) remain open in the intermediate phase in each case.

For programming, the machine has control panel (28) with the proper controls. Such proper controls are shown as six two-way selectors (35) that enable the operator to select the most suitable work cycle among sixty-five options. Panel (28) further incorporates general switch (29) for operation of the machine, which makes it possible to completely stop the machine when desired. This constitutes a safety device. In cases where necessary, provision has been made for total automation of the machine.

Rack (16) is fastened to base plate (6) by means of setscrews (30) through transverse slits (31) provided in rack (16). Transverse slits (31) make it possible to adequately regulate the proper position of rack (16) for engagement of pinion (15), using in relation to setscrews (30) transverse stop rods (32). Transverse stop rods (32) are threaded in the rack itself, which facilitate positioning and correct alignment with the travel of the carriage (7) and further secure immobility.

Finally, for purposes of protection and security, all of the moving parts of the functional mechanisms are intended to be contained inside a methacrylate holder (33), which defines a longitudinal groove (34) for passage of the cartridge collar (12) and tool (11).

It will be understood that this application is intended to cover all modifications and changes of the preferred embodiments of the invention herein chosen for illustration which do not constitute a departure from the spirit and scope of the invention.

I claim:

1. A machine for sterilizing a lipstick bar comprising:

(a) a mobile carrying bench means, said bench means equipped with casters for movement and with means for leveling and stationary anchoring said bench means;

(b) said bench means having a bench top;

(c) a carriage means movably attached to said bench top;

(d) a sterilizing means fixed to said bench top, said carriage means movable in front of said sterilizing means;

(e) detecting means for detecting a position of said carriage means during movement of said carriage means, said detecting means affixed to said bench top;

(f) a rotary means positioned in the carriage means, said rotary means housing and rotating a lipsitck bar to be sterilized during movement of said carriage means;

(g) blocking means for blocking rotation of said lipstick bar by said rotary means, said detecting means controlling the blocking means such that said lipsitck bar is allowed to rotate when said carriage means moves in front of said sterilizing means.

2. The machine according to claim 1, wherein the carriage means moves on longitudinal skids, and a double-acting pneumatic cylinder moves said carriage means.

3. The machine according to claim 2, wherein the rotary means has a pinion that engages a longitudinal stationary rack, such that the lipstick bar is rotated during movement of the carriage means.

4. The machine according to claim 3, wherein the rack is fastened to a stationary base by means of setscrews through slits provided in said rack.

5. The machine according to claim 1, wherein the blocking means has a pair of jaws that close and open during movement of the carriage means.

6. The machine according to claim 5, wherein the pair of jaws is controlled by the detecting means, as a function of the position of the carriage during movement.

7. The machine according to claim 1, wherein the sterilizing means is a block of burners.

8. A machine for sterilizing lipstick comprising:

(a) a bench means having a bench top;

(b) a sterilizing flame means fixed on said bench top; said sterilizing flame means providing radiant heat for sterilizing a lipstick bar;

(c) a carriage means movably attached on said bench top and positioned such that said carriage means moves in front of said sterilizing flame means;

(d) a rotary means attached to said carriage means for housing said lipstick bar during sterilization and for rotating said lipstick bar during movement of said carriage means in front of said sterilizing flame means;

(e) a blocking means for preventing rotation of said lipsitck bar, said blocking means attached to said carriage means; and (f) a detecting means for detecting a position of said carriage means during movement, said detector means fixed on said bench top, said detector means communicating with said blocking means such that said blocking means allows said lipstick bar to rotate when said lipstick bar is in front of said sterilizing flame means such that said lipstick bar is sterilized by said radiant heat.

9. The machine of claim 8 wherein said sterilizing flame means is a gas burner.

10. The machine of claim 9 wherein said bench means has casters attached such that the bench means is portable; said bench means has leveling means for leveling the bench top; and said bench means has anchoring means for anchoring said bench means in a stationary position.

11. The machine of claim 9 wherein longitudinal skids are affixed on said bench top and said carriage means moves on said longitudinal skids.

* * * * *